US007639568B2

(12) United States Patent
Lin

(10) Patent No.: US 7,639,568 B2
(45) Date of Patent: Dec. 29, 2009

(54) TIME COUNTING ASSEMBLY WITH A DISPLAY FOR WORLD TIME ZONES

(75) Inventor: Wen-Chun Lin, Tucheng (TW)

(73) Assignee: Atop Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/783,899

(22) Filed: Apr. 12, 2007

(65) Prior Publication Data

US 2008/0056070 A1 Mar. 6, 2008

(30) Foreign Application Priority Data

Apr. 12, 2006 (TW) ..... 95112946 A
Feb. 8, 2007 (TW) ..... 96104546 A

(51) Int. Cl.
*G04B 19/22* (2006.01)

(52) U.S. Cl. ..... 368/22; 368/27; 368/295

(58) Field of Classification Search ..... 368/21–22, 368/26–27, 294–295
See application file for complete search history.

(56) References Cited

U.S. PATENT DOCUMENTS 3,599,421 A * 8/1971 Walker ..... 368/21
4,157,646 A * 6/1979 Wuthrich ..... 368/253
4,815,053 A * 3/1989 Dal Busco ..... 368/294
5,541,895 A * 7/1996 Nussbaum ..... 368/295
5,822,279 A * 10/1998 Cuche et al. ..... 368/295
6,636,457 B2 * 10/2003 Lin ..... 368/21

* cited by examiner

*Primary Examiner*—Vit W Miska
*Assistant Examiner*—Sean Kayes
(74) *Attorney, Agent, or Firm*—Guice Patents PLLC

(57) ABSTRACT

A time counting assembly with a display for world time zones includes a power source, a second counter, a minute counter, an hour counter, and a time zone display for displaying a correct time over a faceplate. Stirring the time zone adjustable ring with the hand ultimately turns a hour hand to the time in accordance with the time zone corresponding to a second landmark.

10 Claims, 14 Drawing Sheets

TIME COUNTING ASSEMBLY WITH A DISPLAY FOR WORLD TIME ZONES

BACKGROUND OF THE INVENTION

1. Field of the Invention

The present invention relates to a time counting assembly, and particularly to a time counting assembly with a display for world time zones.

2. Description of Related Art

It is known that the international exchange is getting more frequent and the transnational contact is getting popular due to the advance of the traffic and communication. In order to consider the factor with regard to the transmission of information and to the time difference, a clock possible to show the time of any other zone, or the so-called world time clock is developed to respond the necessity.

Mostly, a conventional world time clock at the dial thereof is printed with a world map and a local time is looked up in the world map. The deficiency involved in the conventional world time clock is that the dial appears too much complicated and it does not fulfill the criterion of human engineering from the standpoint of vision cognition and transmission.

Taking a simple type of world time clock as an example, the movement of this world time clock provides a 24-hour display and the periphery of the dial thereof engages with a time zone ring with 24 typical city names thereon to represent 24 time zones. When the local city name is turned to correspond to the local time in the time zone ring, the time of another related city can be figured out. However, the simple type of world time clock is also involved in a defect that the movement has to provide a 24-hour display. Moreover, the time zone ring is easily loosened after using a period of time caused by no locating device available for the time zone ring being steadily attached to the dial such that it may result in a difficulty of reading the time. Besides, the time zone ring on the simple type of world time clock is disposed to have a distance from the 24-hour graduation on the dial so that it is easy to occur a reading error. Furthermore, the dial has to be arranged with 24 graduations standing for 24 hours and the gap between two neighboring hour graduations is reduced in a limited space such that it is unfavorable for the reading of minute hand and it is not possible for the alarm being aligned accurately.

SUMMARY OF THE INVENTION

The present invention has been accomplished under the circumstances in view. It is therefore the main object of the present invention to provide a time counting assembly with a display for world time zones, which has a low profile feature with world time zone display and adjustable functions suitable for use in a watch, According to one embodiment of the present invention, the time counting assembly with a display for world time zones comprises a power source, a second counter, a minute counter, an hour counter, and a time zone display for displaying a correct time over a faceplate; wherein the time zone display further comprises a time zone adjustable ring rotatably set between a substrate and the faceplate, providing a planetary idle gear set between the substrate and the faceplate to mesh an inner gear ring of the time zone adjustable ring and a planetary base wheel, which is pivoted to a bottom of the substrate, the planetary base wheel allowing a minute wheel set to pass therethrough, the planetary base wheel having a bottom circumferentially pivotally mounted with a front hour wheel of the hour counter, and at least two engaging hooks radially connected to a bottom of the substrate to engage a plurality of ratchet holes that are arranged around the periphery of a top side of the time zone adjustable ring; whereby stir the time zone adjustable ring with the hand to align a first landmark of a local time zone with a fixed point and then calibrate the time counting assembly in accordance with the local time, and then stir the time zone adjustable ring with the hand to align a second landmark of another locating time zone with the fixed point such that the inner gear ring moves the planetary idle gear set and the planetary base wheel to shift engagement of the engaging hooks in the ratchet holes, and the front hour wheel is rotated on the planetary base wheel with a planetary movement along the minute wheel set to cause rotation of a meshed hour wheel so as to turn a hour hand to the time in accordance with the time zone corresponding to the second landmark.

According to another embodiment of the present invention, the time counting assembly with a display for world time zones comprises a power source, a second counter, a minute counter, an hour counter, and a time zone display for displaying a correct time over a faceplate; wherein the time zone display further comprises a time zone adjustable ring and a retaining ring synchronously rotatably set between a substrate and the faceplate, providing a planetary idle gear set between a substrate and the faceplate to mesh an inner gear ring of the time zone adjustable ring and a planetary base wheel, which is pivoted to a bottom of the substrate, the planetary base wheel allowing a minute wheel set to pass therethrough, the planetary base wheel having a bottom circumferentially pivotally mounted with a front hour wheel of the hour counter, the retaining ring having at least two obliquely inwardly engaging hooks to engage a plurality of ratchet holes on the periphery of a bottom side of the substrate; whereby stir the time zone adjustable ring with the hand to align a first landmark of a local time zone with a fixed point and then calibrate the time counting assembly in accordance with the local time, and then stir the time zone adjustable ring with the hand to align a second landmark of another locating time zone with the fixed point such that the inner gear ring moves the planetary idle gear set and the planetary base wheel to shift engagement of the engaging hooks in the ratchet holes, and the front hour wheel is rotated on the planetary base wheel with a planetary movement along the minute wheel set to cause rotation of a meshed hour wheel so as to turn a hour hand to the time in accordance with the time zone corresponding to the second landmark.

BRIEF DESCRIPTION OF THE DRAWINGS

The present invention can be more fully understood by referencing to the following detailed description and accompanying drawings, in which.

DETAILED DESCRIPTION OF THE PREFERRED EMBODIMENTS

Figure 1A:
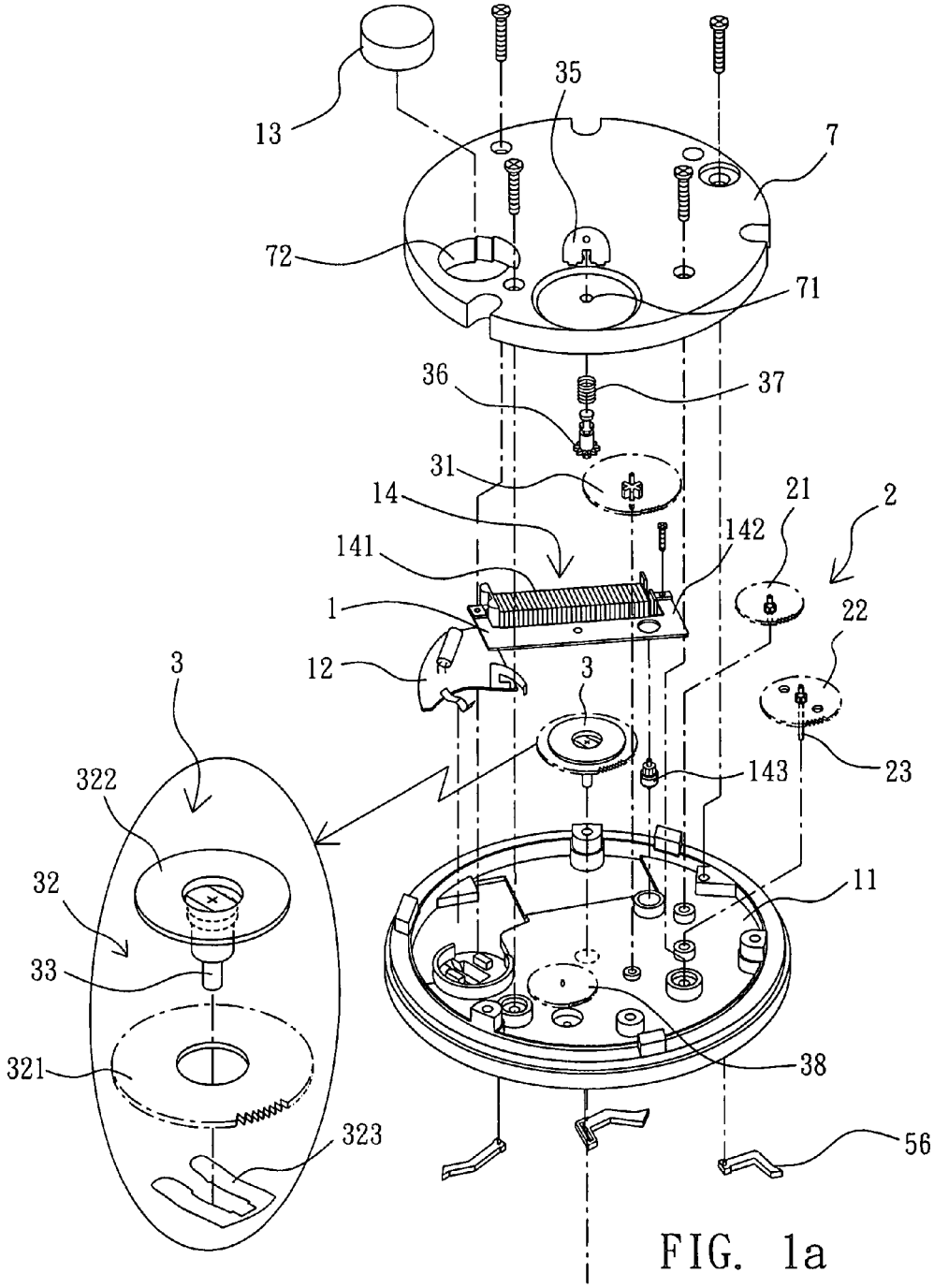
FIGS. 1*a* and 1*b* are exploded perspective view of a time counting assembly with a display for world time zones according to a first embodiment of the present invention.

Referring to FIGS. 1*a* to 6, a time counting assembly with a display for world time zones according to the present invention basically comprises a power source 1, a second counter 2, a minute counter 3, an hour counter 4, and a time zone display 5. In addition, the time counting assembly of the present invention further comprises a day-night display 6.

The power source 1 is disposed above a substrate 11 and a circuit board 12, and the power source 1 provides a battery 13 mounted to the circuit board 12. Thus, the power can be supplied to a conventional stepping motor 14 composed of a coil 141, stator 142, and a rotor 143 so that the rotor 143 can rotate with a constant speed to transmit the power to the second counter 2.

The second counter 2 provides a front second wheel 21 is axially attached to the substrate 11 and meshes with the rotor 143 so as to be driven by the rotor 143. The front second wheel 21 further meshes with a second wheel 22 so that a second spindle 23 under the second wheel 22 can rotate a revolution per minute. The second spindle 23 extends beyond the faceplate 53 to pivotally connect with a second hand/disk 24.

The minute counter 3 provides a front minute wheel 31, which is disposed on the substrate 11, to mesh with the second wheel 22 and the lower part of front minute wheel 31 passes over the substrate 11 and the circuit board 12 to mesh with a minute wheel set 32 so as to obtain an effect of speed reduction. The minute wheel set 32 at the bottom thereof connects with a minute spindle 33 and the minute spindle 33 extends through the faceplate 53 to fit with a minute hand 34 such that the minute hand 34 can turn 6° per revolution of the second hand/disk 24.

Wherein, the minute wheel set 32 provides a minute wheel 321 movably fits with a minute wheel spindle 322 and secured thereto with a retaining strip 323. An advantage of this arrangement is that, as soon as a time adjusting knob 35 is lifted and turned, a ratchet tooth stem 36 which extends over a cover plate 7 is lifted to compress a spring 37 thereon, causing relative rotation between the ratchet tooth stem 36 and a driven wheel 38 that is pivoted to the surface of the substrate 11, such that a minute wheel spindle 322, which meshes with the driven wheel 38 can rotate to move the minute wheel set 32 and the hour counter 4 for obtaining a purpose of time adjustment. The minute wheel 321 turns in a state of idling in spite of being driven by the front minute wheel 31 and the second spindle 23 keeps turning with a constant speed to avoid a possible error resulting from a stop of the second spindle 23 during the time correction.

The hour counter 4 axially connects with a planetary base gear 51 at the bottom of the substrate 11 and a front hour wheel 41 which is pivoted to the bottom side of the planetary base gear 51 near one side meshes with the minute wheel spindle 322, which extends over the substrate 11 and the planetary base gear 51, such that the front hour wheel 41 can rotate with the planetary base gear 51 to perform a planetary movement. Besides, the front hour wheel 41 at the position of a faceplate 53 meshes with an hour wheel 42 such that the speed of the hour wheel 42 can be reduced to turn 30° per 60 minutes. Hence, the hour wheel 42 passes through the faceplate 53 and connects with an hour hand 43.

The planetary base gear 51 of the time zone display 5 is coupled to the bottom of the substrate 11 at the center with its center hole for the passing of the minute wheel spindle 322 and meshes the front hour wheel 41. A time zone adjustable ring 52 is set between the substrate 11 and the faceplate 53. The time zone adjustable ring 52 has a plurality of connecting portions 521, for example projections, to connect with a landmark ring 81 (see FIG. 6), which has carried thereon typical city names corresponding to 24 time zones. The time zone adjustable ring 52 provides an inner gear ring 522 to mesh with a planetary idle gear 54, which axially connects with the faceplate 53 at a circumferential opening thereof. Besides, the planetary base gear 51 meshes a planetary driven gear 55, which has a plurality of bottom insertion holes 551 respectively coupled to respective pins 541 of the planetary idle gear 54 such that a planetary idle gear set can be constituted accordingly.

Moreover, at least two engaging hooks 56 are radially peripherally provided at the bottom of the substrate 11 to engage a plurality of ratchet holes 523, which are equiangularly arranged above the inner gear ring 522. Thus, as soon as the time zone adjustable ring 52 is turned to one of the time zones and the planetary idle gear 54 rotates with the planetary driven gear 55, the planetary base gear 51 can be driven by the planetary driven gear 55 to rotate the front hour wheel 41 with a planetary movement. Next, the hour wheel 42 can be turned along with the hour hand 43 on the faceplate 53 synchronously. In fact, while the planetary base gear 51 is in a state of planetary movement, the front hour wheel 41 rotates about the minute wheel spindle 322 without interfering the movement of the planetary base gear 51 so that it is not possible to generate an error of time reading.

Besides, the ratchet holes 523 are unidirectional and its number is 24 corresponding to the 24 typical city names of the 24 time zones on the landmark ring 81 so that the time zone adjustable ring 52 can only turn in a reverse direction during being stirred with hand. In the mean time, the at least two engaging hooks 56 can selectively engage with the ratchet holes 523 to perform a sharp pause at an exact hour location.

Figure 1B:
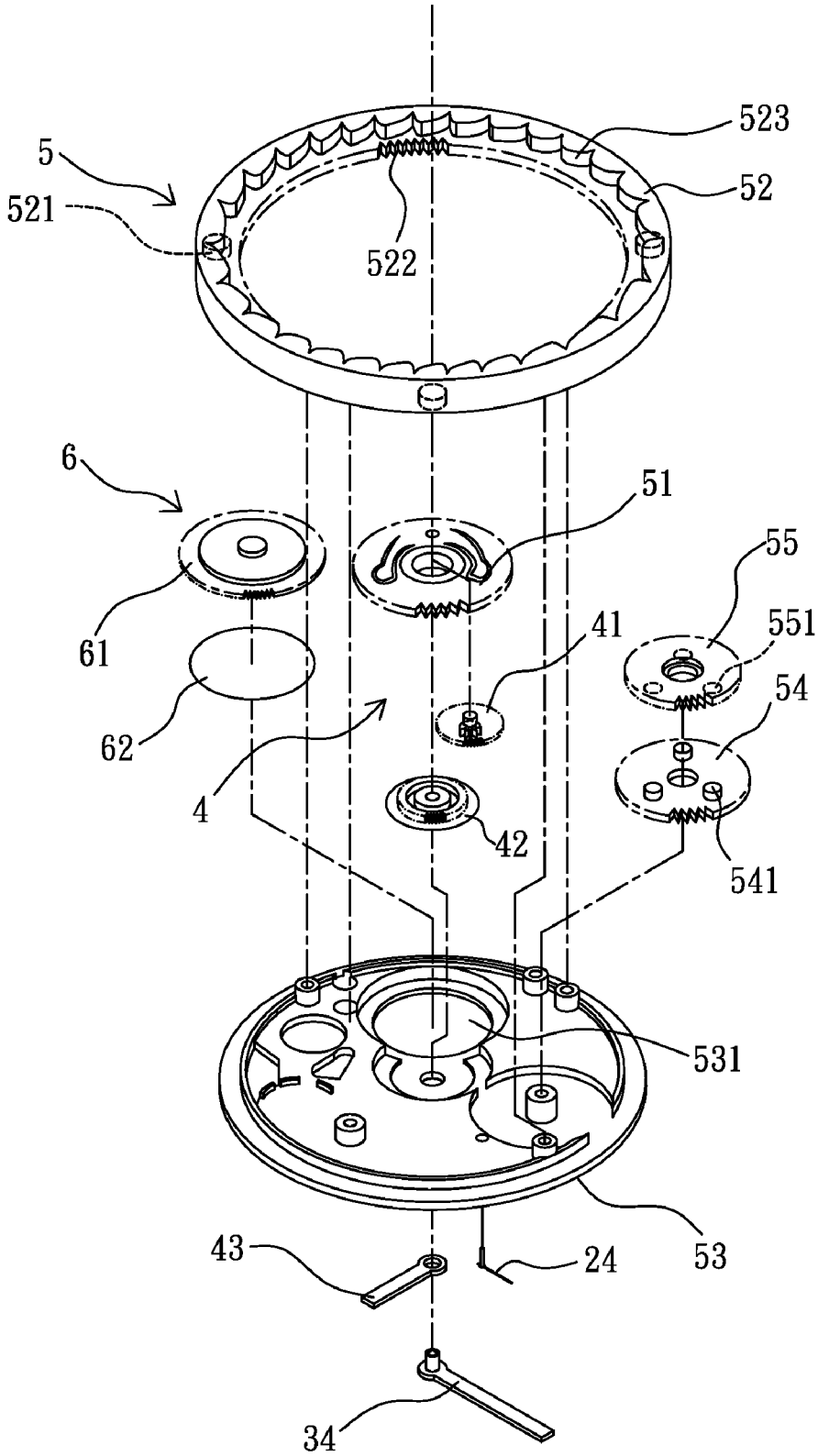
Figure 2:
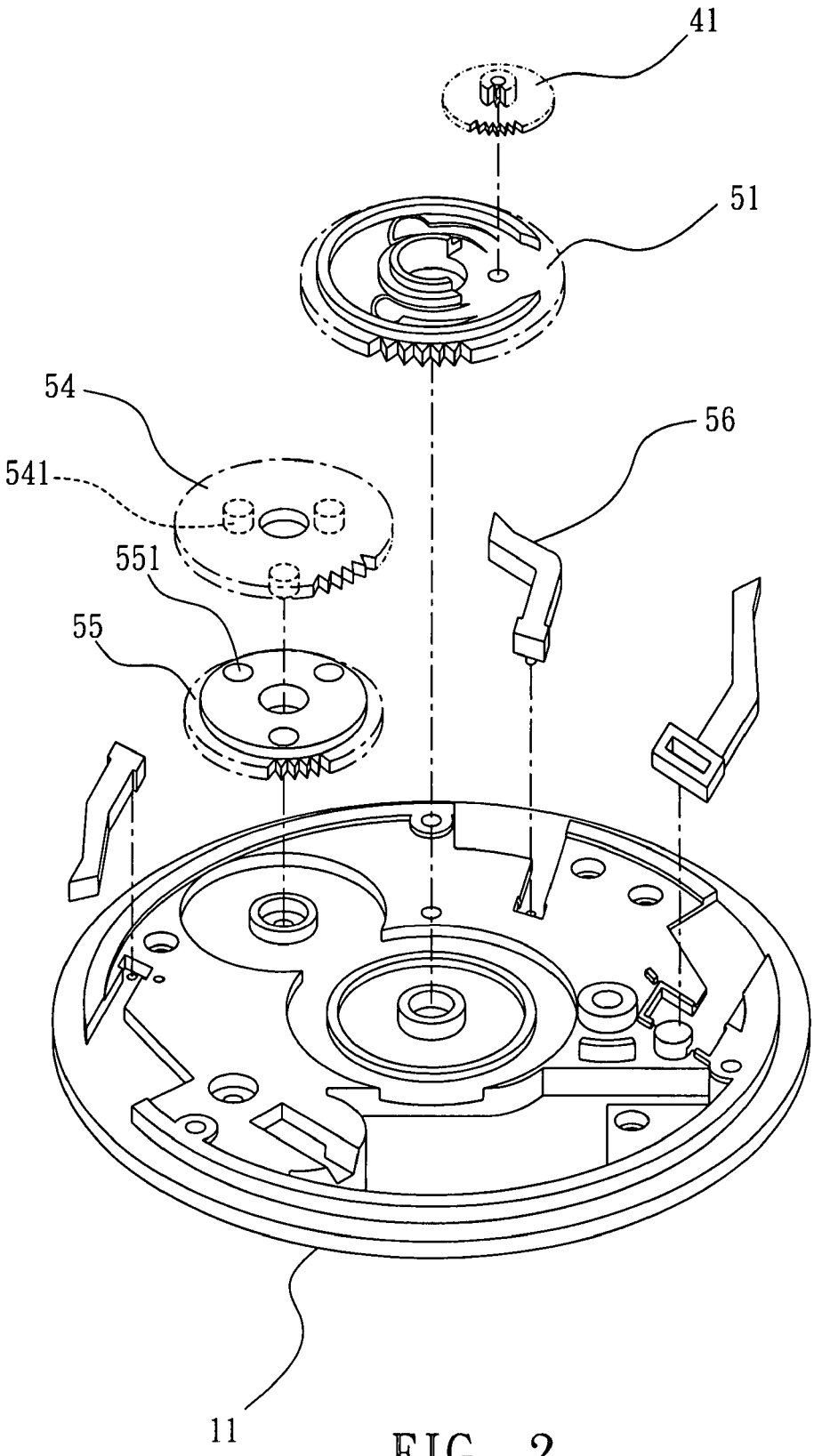
FIG. 2 is an exploded view of a part of the first embodiment of the present invention, showing the relationship between the substrate and the related parts.
Figure 3:
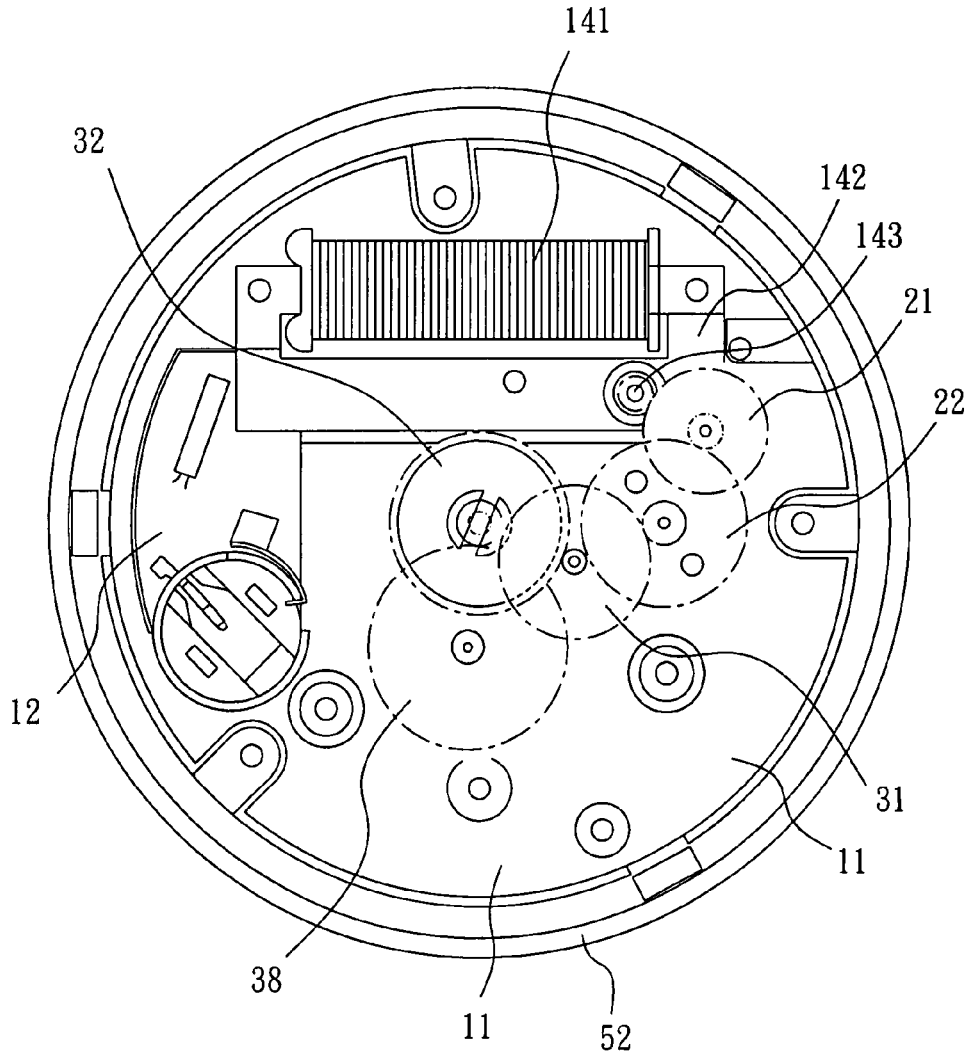
FIG. 3 is a schematic view after assembled of the parts shown in FIG. 2.
Figure 4:
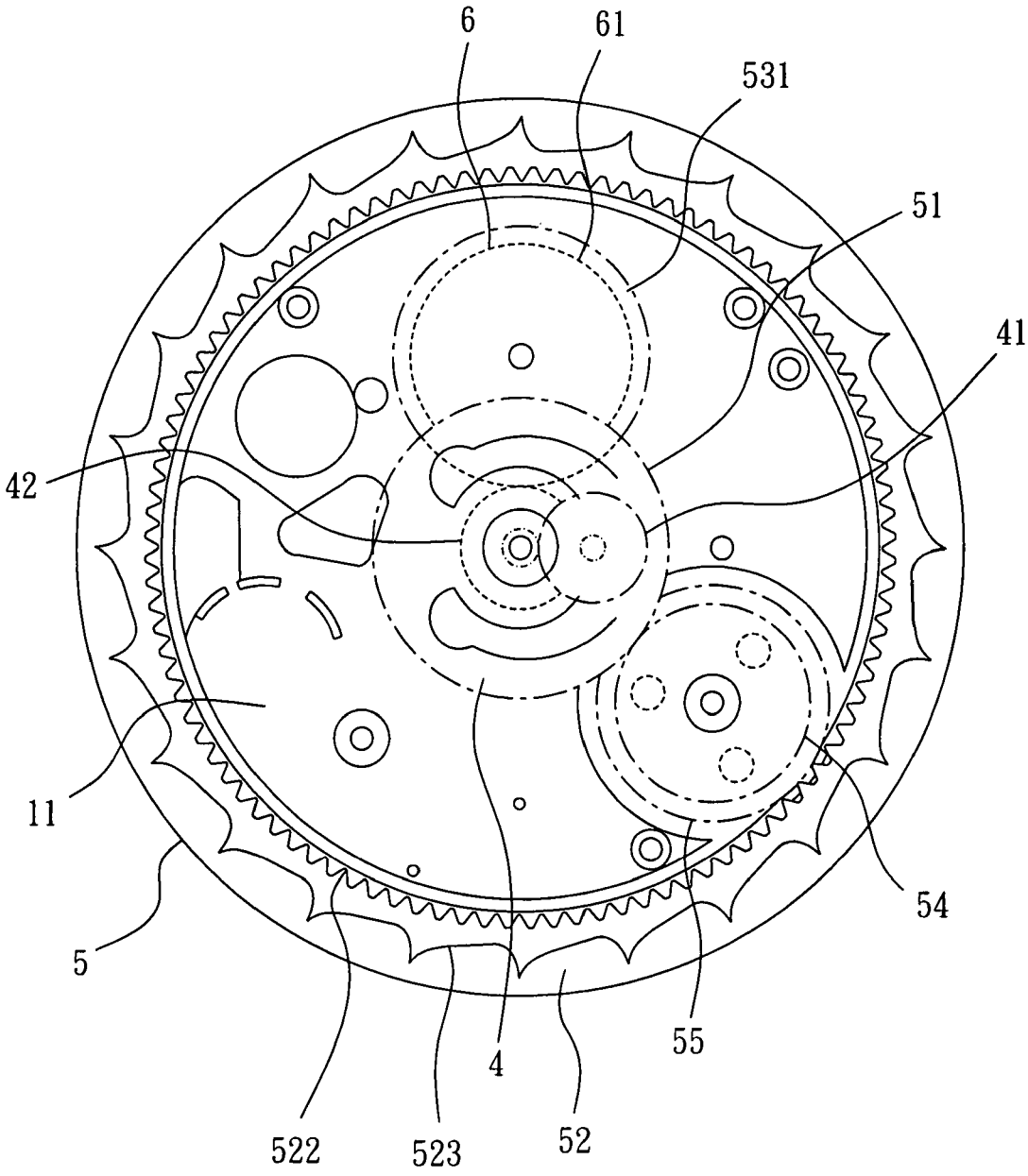
FIG. 4 is a plan view illustrating parts attached to the bottom of the substrate according to the first embodiment of the present invention.
Figure 6:
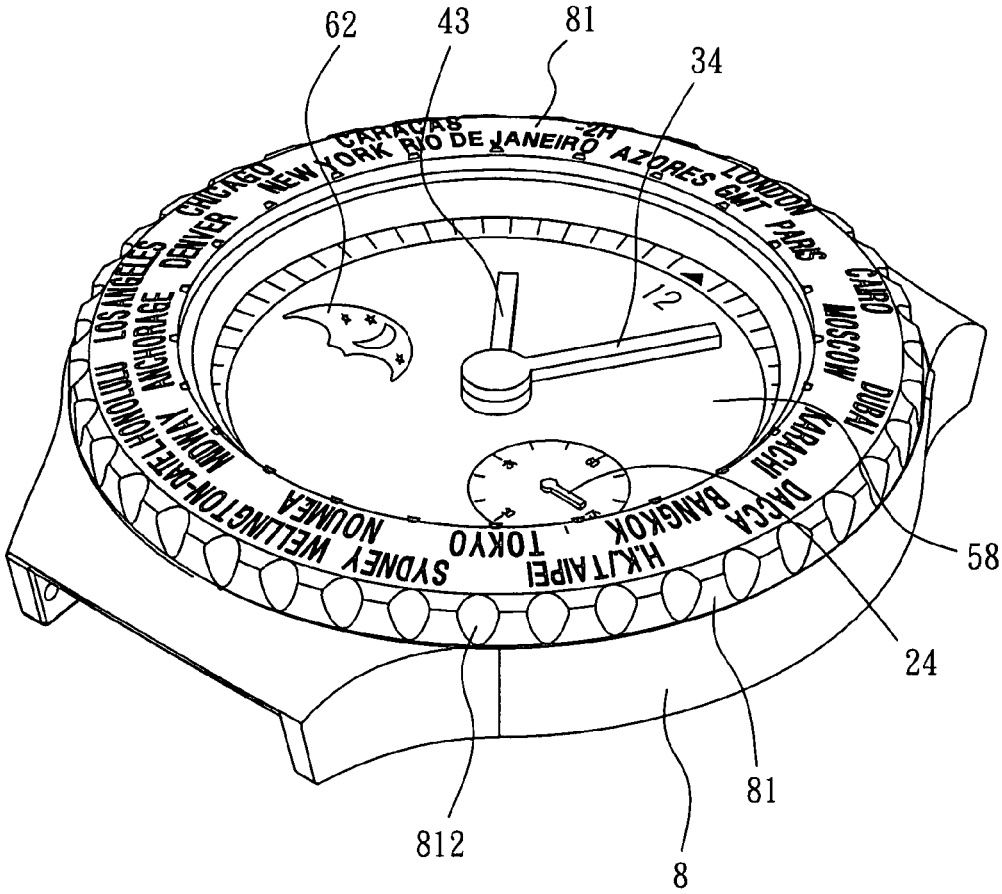
FIG. 6 is a perspective assembly view of FIG. 5.
Figure 7A:
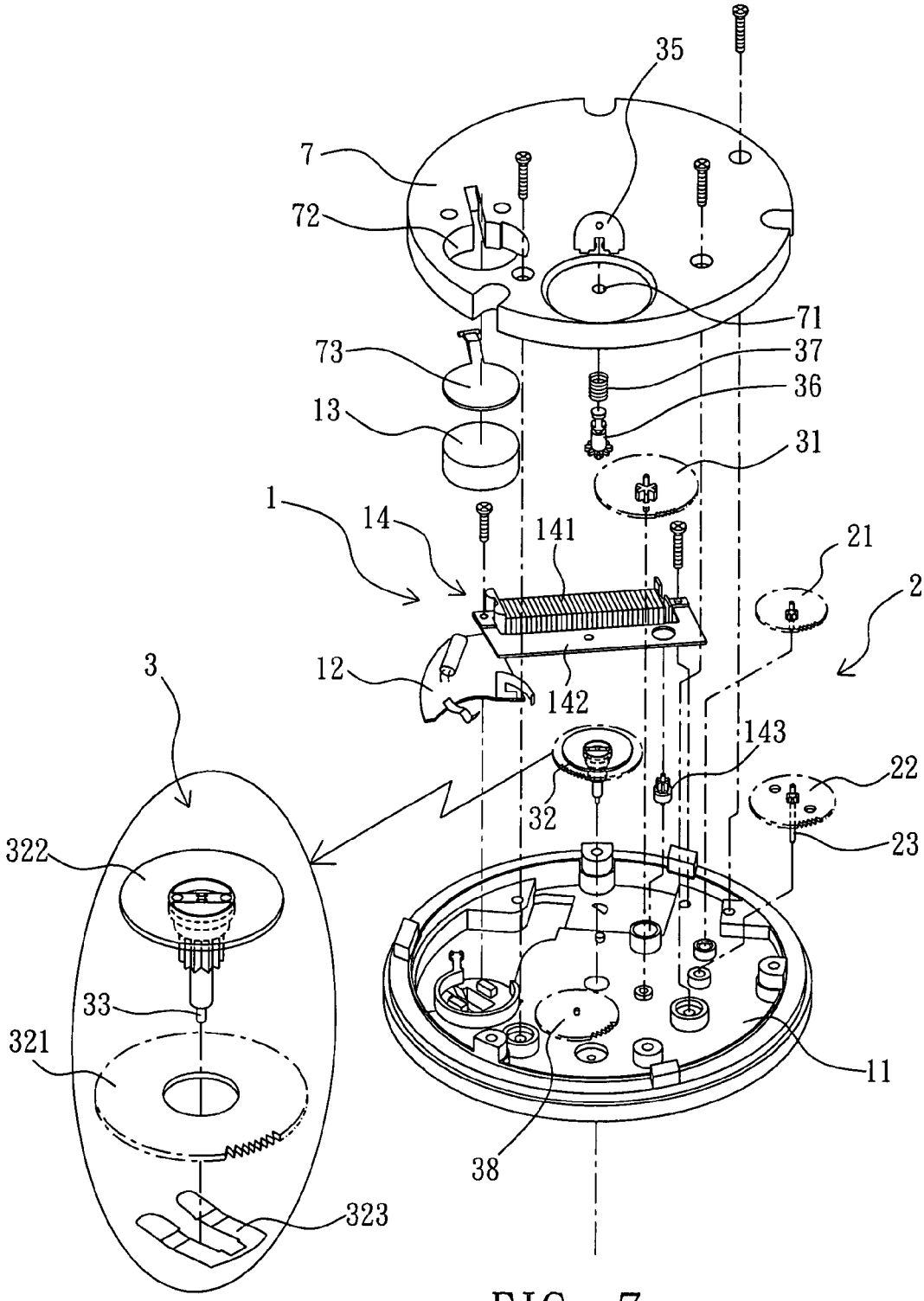
FIGS. 7*a* and 7*b* are exploded view of a time counting assembly with a display for world time zones in accordance with a second embodiment of the present invention.
Figure 7B:
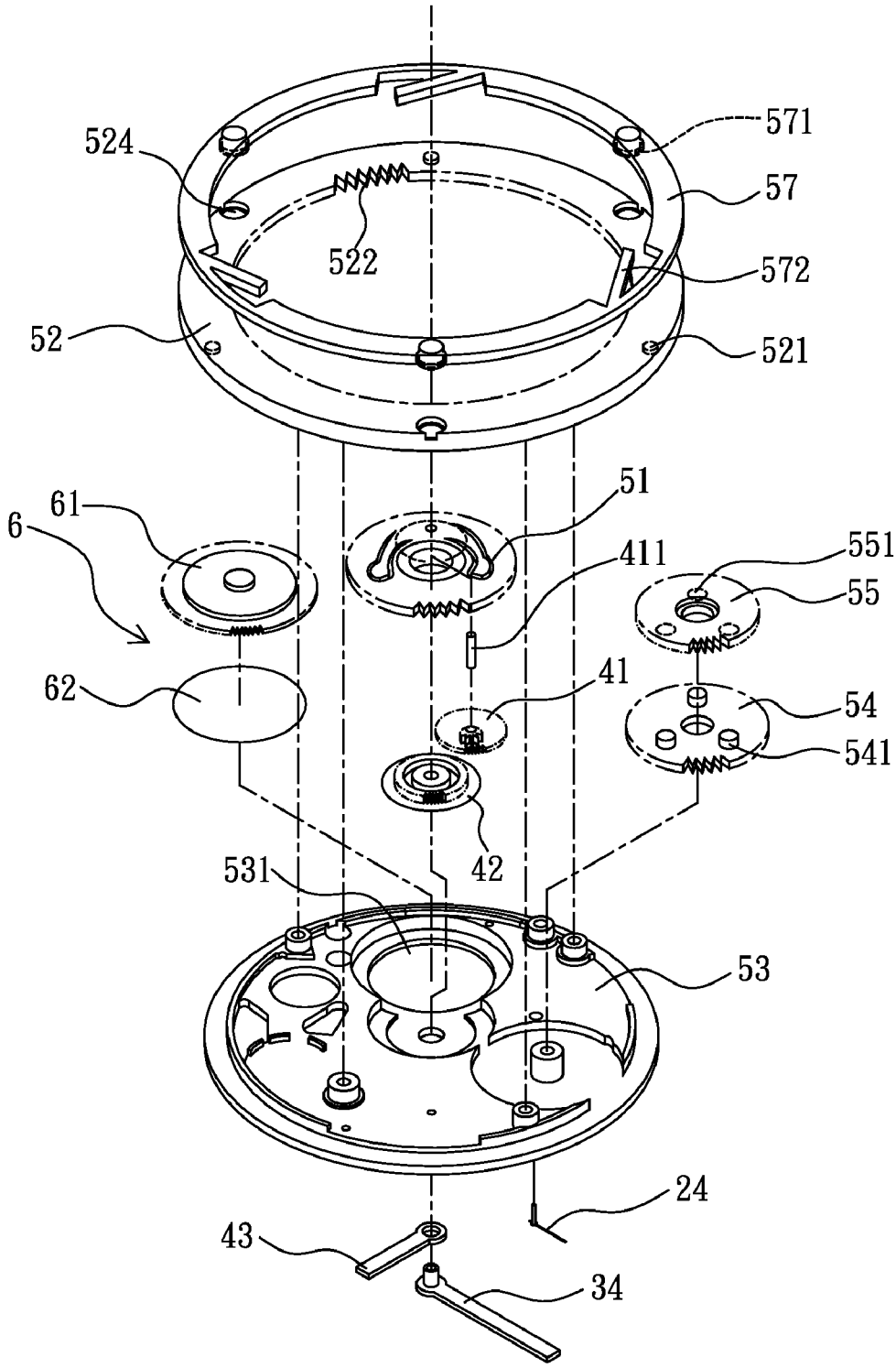
Figure 8:
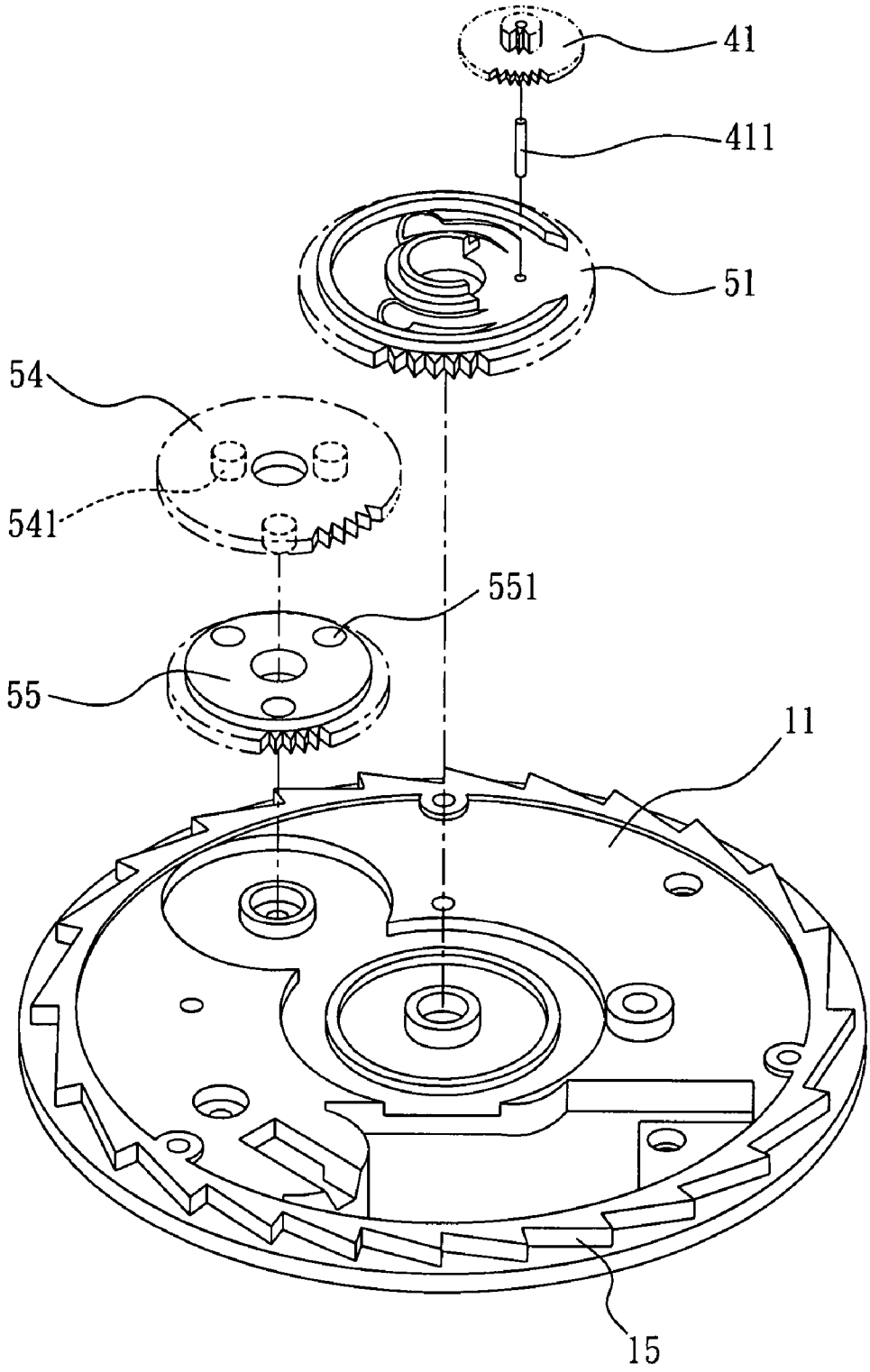
FIG. 8 is an exploded view of a part of the second embodiment of the present invention, showing the relationship between the substrate and the related parts.
Figure 9:
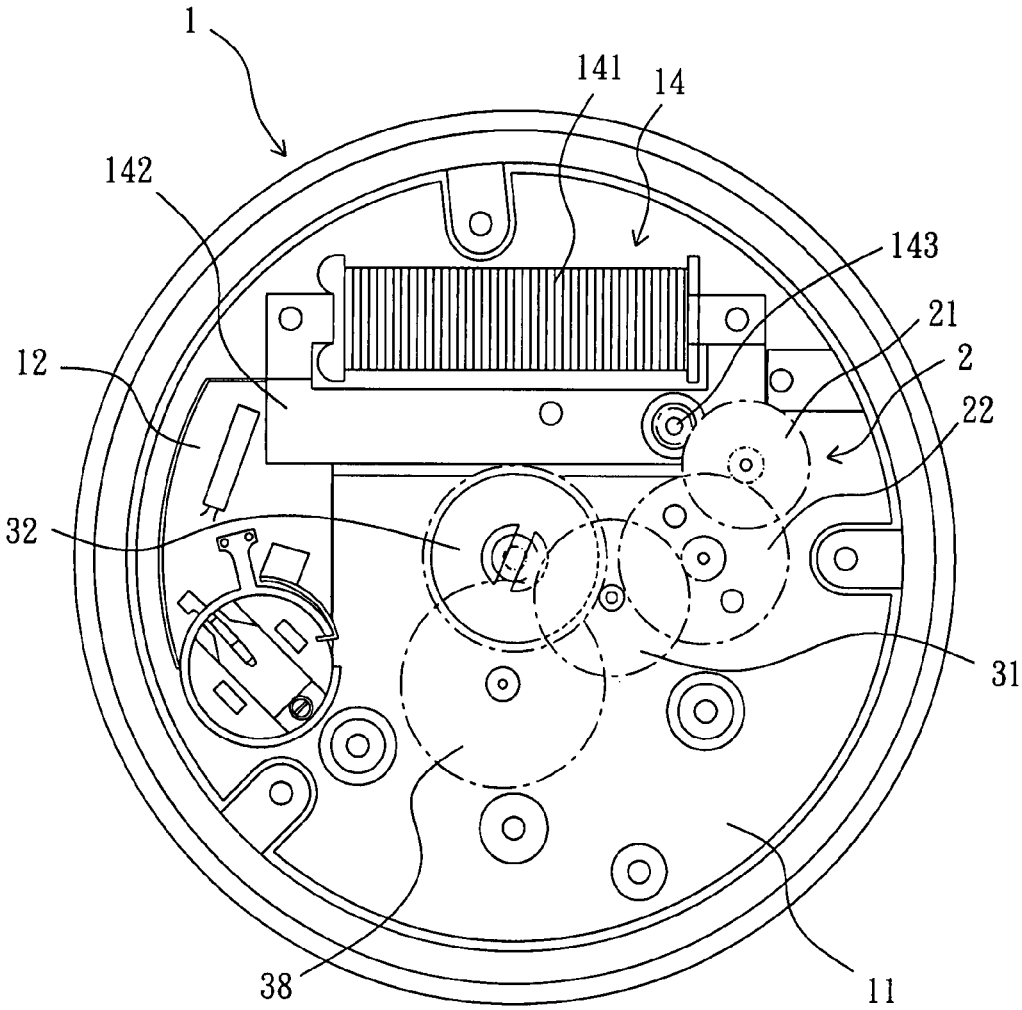
FIG. 9 is schematic drawing after assembled of the parts shown in FIG. 7 above the substrate.
Figure 10:
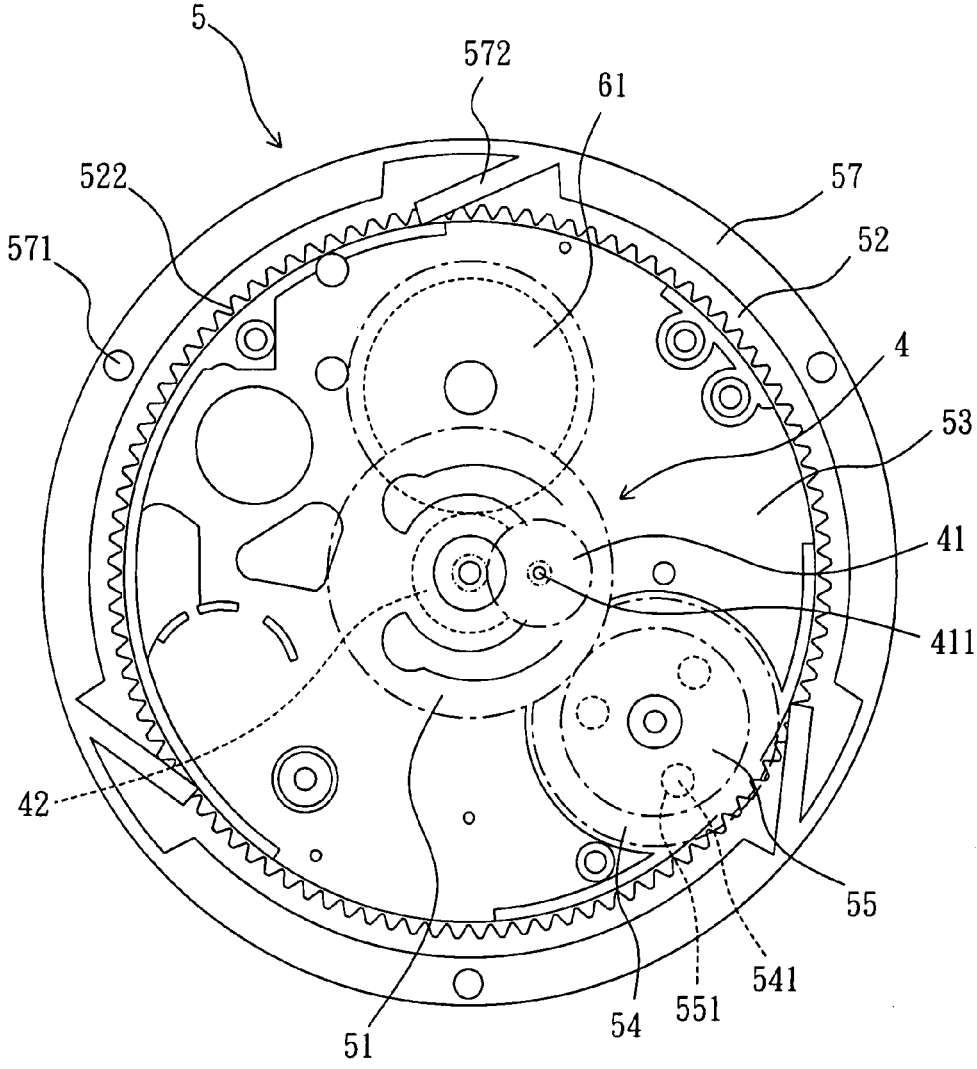
FIG. 10 is schematic drawing after assembled of the parts shown in FIG. 7 beneath the substrate.

Referring to FIGS. 1*b* and 6 again, the present invention further comprises a day-night display 6, which is possible for being known the state of daytime or the state of nighttime if it is necessary. The day-night display 6 provides a day-night gear 61, which is pivoted to the substrate 11 and meshed with the hour wheel 42. The day-night gear 61 is received in a hole 531 on the faceplate 53 for rotation with the hour wheel 42. The day-night gear 61 carries a decoration mark 62 (see FIG. 6) as a day-night symbol to indicate the state of daytime or the state of nighttime. Due to engaging with the hour wheel 42 constantly, the day-night gear 61 runs along with the hour wheel 42 so that the situations of day and night with regard to the local time of the user can be shown under a normal state. When the user stirs the time zone adjustable ring 52 with hand, the hour wheel 42 may generate an opposite turning and the day-night gear 61 further turns along with the hour wheel 42. As soon as the day-night gear 61 is adjusted to a desired time zone, the decoration mark 62 represents the situation of day-night of the local time. Hence, the 12-hour movement disclosed in the present invention can distinguish the state of daytime from the state of nighttime and display the time corresponding to the respective state.

The cover 7 is provided to be attached to the substrate 11 and at the outer surface thereof has a stem hole 71 and a battery hole 72 for receiving the ratchet tooth stem 36 and a battery 13 respectively. The battery hole 72 can be closed with a battery cover. Alternatively, the time counting assembly can be mounted in a casing 8 and covered with a back cover 84 on the back side of the casing 8 to prohibit escape of the battery 13.

FIGS. 7*a*~12 show a time counting assembly in accordance with a second embodiment of the present invention. This second embodiment alters the structure of the ratchet holes and inner gear ring of the time zone adjusting ring and the at least two engaging hooks. The time counting assembly with a display for world time zones according to this second embodiment basically comprises a power source 1, a second counter 2, a minute counter 3, an hour counter 4, and a time zone display 5. In addition, the time counting assembly of this second embodiment further comprises a day-night display 6. The power source 1, the second counter 2, the minute counter 3, and the day-night display 6 are substantially similar to the like parts in the aforesaid first embodiment, therefore no further description of the joining relationship among related parts is necessary.

The difference between the hour counter 4 of this second embodiment and the hour counter of the aforesaid first embodiment is that the front hour wheel 41 is circumferentially pivoted to the bottom of the planetary base gear 51 with a pivot shaft 411.

The planetary base gear 51 of the time zone display 5 is axially coupled to the bottom of the substrate 11 with its center hole for the passing of the minute wheel spindle 322, and meshed with the front hour wheel 41 at the bottom of the substrate 11. The time zone adjustable ring 52 is set with a retaining ring 57 between the substrate 11 and the faceplate 53. The time zone adjustable ring 52 has a plurality of connecting portions 521, for example projections, to connect with a landmark ring 81 (see FIG. 12). The time zone adjustable ring 52 provides an inner gear ring 522 to mesh with a planetary idle gear 54, which axially connects with the faceplate 53 at a circumferential opening thereof. Besides, the planetary base gear 51 meshes a planetary driven gear 55, which has a plurality of bottom insertion holes 551 respectively coupled to respective pins 541 of the planetary idle gear 54 such that a planetary idle gear set can be constituted accordingly.

Moreover, a plurality of ratchet holes 15 are arranged on the bottom of the substrate 11 around its periphery, and the retaining ring 57 has a plurality of pins 571 respectively engaged into respective pin holes 524 on the time zone adjustable ring 52 such that the retaining ring 57 can be rotated with the time zone adjustable ring 52 synchronously. The retaining ring 57 has obliquely inwardly extending from the periphery thereof at least two engaging hooks 572 to engage the ratchet holes 15. Thus, as soon as the time zone adjustable ring 52 is turned to one of the time zones and the planetary idle gear 54 rotates with the planetary driven gear 55, the planetary base gear 51 can be driven by the planetary driven gear 55 to rotate the front hour wheel 41 with a planetary movement. Next, the hour wheel 42 can be turned along with the hour hand 43 on the faceplate 53 synchronously. In fact, while the planetary base gear 51 is in a state of planetary movement, the front hour wheel 41 rotates about the minute wheel spindle 322 without interfering the movement of the planetary base gear 51 so that it is not possible to generate an error of time reading.

Besides, the ratchet holes 15 are unidirectional and its number is 24 corresponding to the 24 typical city names of the 24 time zones on the landmark ring 81 so that the time zone adjustable ring 52 can only turn in a reverse direction during being stirred with hand. In the mean time, the at least two engaging hooks 572 of the retaining ring 57 can selectively engage with the ratchet holes 15 to perform a sharp pause at an exact hour location.

The cover 7 is provided to be attached to the substrate 11 and at the outer surface thereof has a stem hole 71 and a battery hole 72 for receiving the ratchet tooth stem 36 and a battery 13 respectively. The battery hole 72 can be closed with a battery cover 73.

Figure 5:
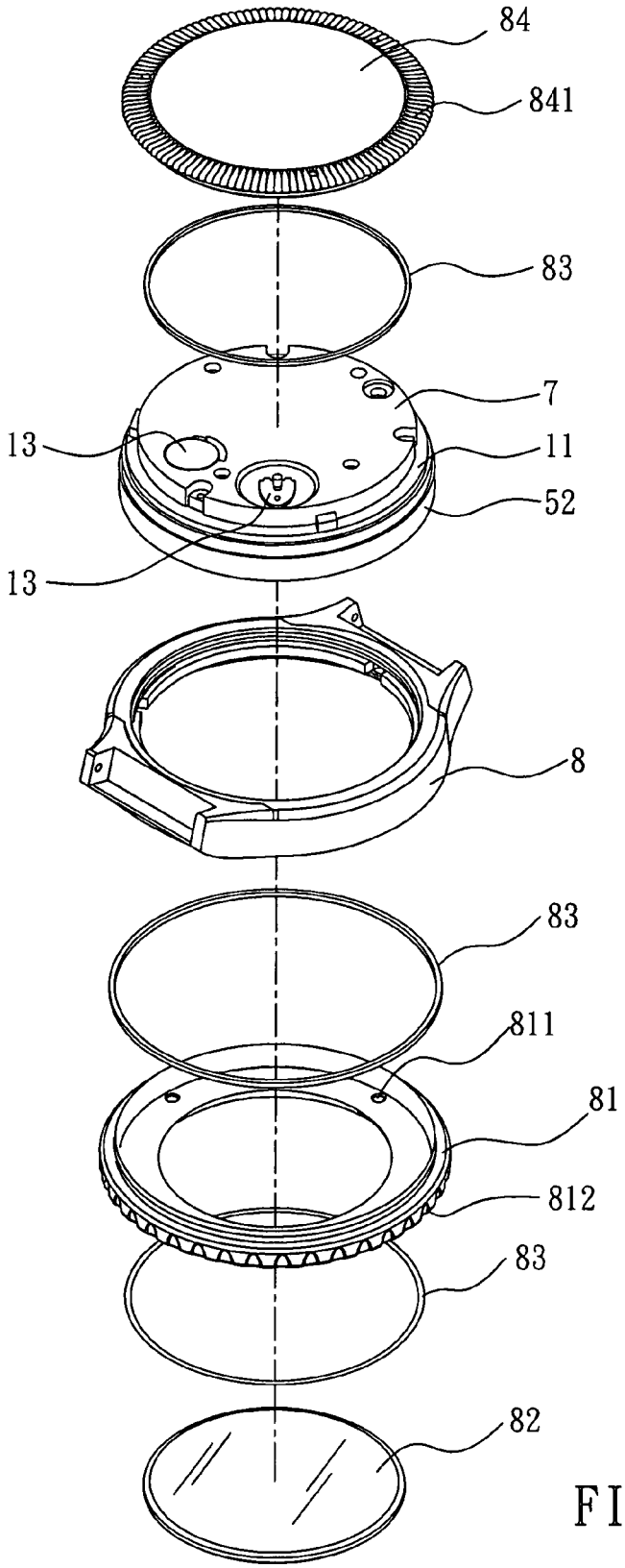
FIG. 5 is an exploded view of a casing and the time counting assembly with a display for world time zones according to the first embodiment of the present invention.
Figure 11:
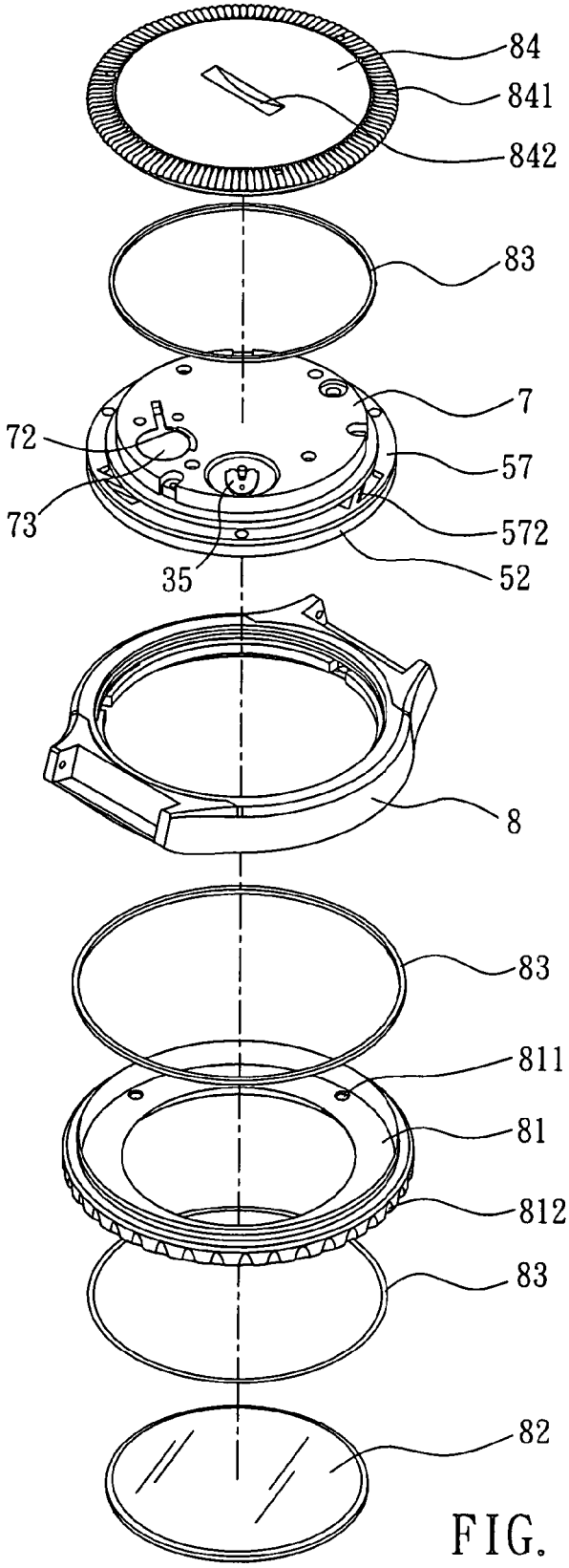
FIG. 11 is an exploded view of a casing and the time counting assembly with a display for world time zones according to the second embodiment of the present invention.

Referring to FIGS. 5 and 11, the time counting assembly according to either the first embodiment or the second embodiment can be mounted in a casing 8, for example, a watch casing. The landmark ring 81 is secured to the front side of the casing 8, having 24 typical city names of the 24 time zones marked thereon. The landmark ring 81 has a plurality of connecting portions 811, for example, recesses corresponding to the connecting portions 521 of the time zone adjustable ring 52 such that stir the landmark ring 81 moves the time zone adjustable ring 52 for viewing of the times in other time zones. Further, the landmark ring 81 is covered with a lens 82. To provide a waterproof function, a gasket ring 83 is respectively provided between the lens 82 and the landmark ring 81 and between the landmark ring 81 and the casing. Further, a back cover 84 is covered on the back side of the casing 8. By means of stirring the peripheral embossment 841 or center finger groove 842 to rotate the back cover 84, the back cover 84 is fastened to or disconnected from the casing 8, facilitating time correction or battery 13 replacement. Further, to facilitate turning of the landmark ring 81, grooves 812 are provided around the periphery of the landmark ring 81 for the positive contact of the hand. Further, an ornamental plate 58 is fastened to the front side of the faceplate 53 for decoration. The ornamental plate 58 has time graduations, i.e., graduations for hours, minutes and seconds, and a semicircular window for viewing of the state of daytime and the state of nighttime. These are of the known art, no further detailed description is necessary.

Referring to FIGS. 6 to 12, while the time counting assembly with a display for world time zones of the present invention is in use, the user aligns the local landmark, for example, H.K./Taipei with a fixed point such as the 12 o'clock first and then the time adjusting knob 35 is turned to calibrate the minute counter 3 and the hour counter 4 in accordance with the local time. Next, the time shown on the day-night display 6 can be read by way of the decoration mark 62 thereof such as the time being adjusted to 12 o'clock at noon. In order to look into another time zone such as the time in Chicago, it is only necessary to stir the landmark ring 81 to move the time zone adjustable ring 52 and the hour counter 4 synchronously and the landmark of Chicago is aligned with the direction of 12 o'clock such that the day-night gear 61 shows a decoration mark 62 representing the night at the present time with the hour hand 43 indicating 10 o'clock and it means the present time in Chicago is 10 o'clock at night, which is not appropriate to make a business phone call.

Figure 12:
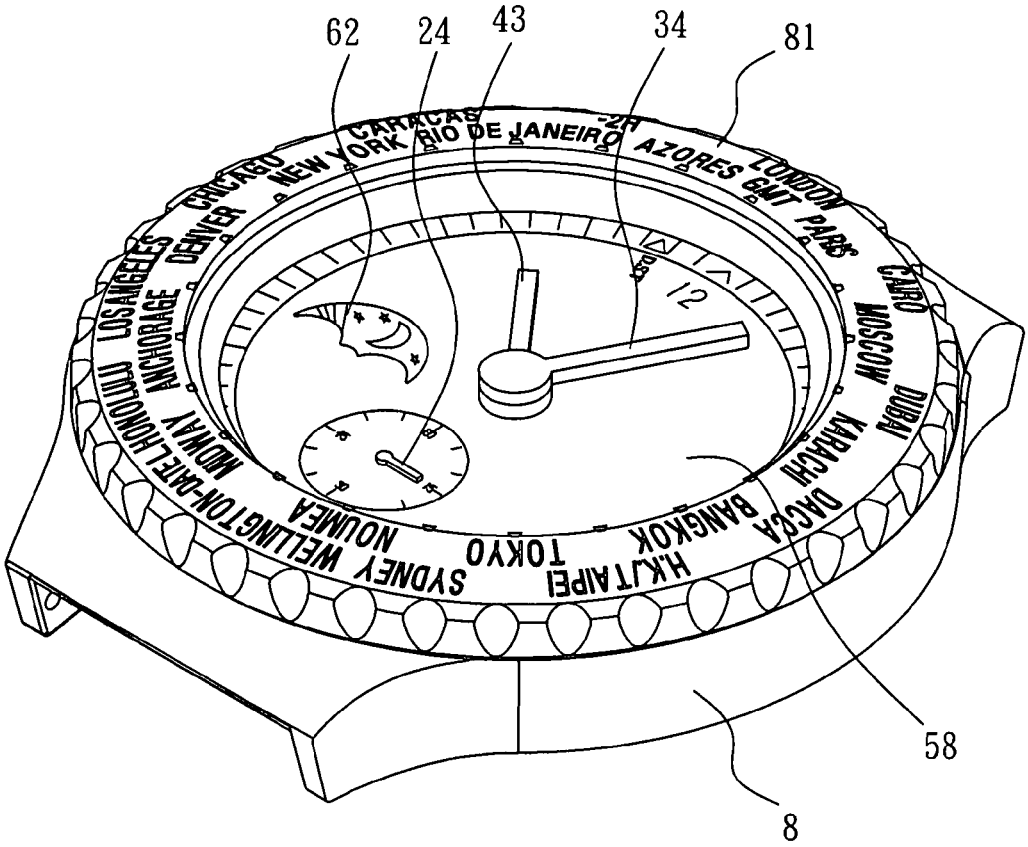
FIG. 12 is a perspective assembly view of FIG. 11.

If local daylight saving time is held from March through October, as shown in FIG. 12, a D.S.T. position mark is marked on the ornamental plate 58. While adjusting the time subject to the local daylight saving time, rotate the landmark ring 81 counter-clockwise to move the time zone adjustable ring 52 synchronously to have the landmark of the set city be aligned with the D.S.T. position mark, eliminating a complicated hour hand adjustment procedure.

It is appreciated that the advantages of the present invention can be summarized hereinafter:

(1) It provides a low profile feature. When compared to Taiwan Patent 90117521 (equivalent to U.S. Pat. No. 6,636,457 and China 01120668.3), the time counting assembly of the present invention reduces the number of parts to reduce the thickness of the whole assembly so that the time counting assembly is usable in a watch or low-profile timer while maintaining world time zone display and adjustable functions, and providing a modularized design function for ultra-thin time recording device.

(2) It is easy for the user to read the time. Because the present invention adopts a 12-hour movement to display the time so that the local time and other time zones can be easily read without changing the accustomed way for reading the time.

(3) It is easily operated and offers accurate time information. In case of other time zones being checked, it is only necessary to stir the time zone adjustable ring such that the hour counter can perform a planetary movement on the planetary basic gear and it is possible for the hour counter to move along with exact hour graduation for the specific time at both places respectively or for the time difference between both places being distinguishable easily and conveniently.

(4) It provides a function of day-night reading. The difference between decoration marks shown on the day-night display disk is possible for the user to differentiate the state of daytime or nighttime for a certain time zone easily.

While the invention has been described with reference to a preferred embodiment thereof, it is to be understood that modifications or variations may be easily made without departing from the spirit of this invention, which is defined by the appended claims.

What is claimed is:

1. A time counting assembly with a display for world time zones, comprising a power source, a second counter, a minute counter, an hour counter, and a time zone display for displaying a correct time over a faceplate; wherein the time zone display further comprises:

a time zone adjustable ring rotatably set between a substrate and the faceplate, providing a planetary idle gear set between the substrate and the faceplate to mesh an inner gear ring of said time zone adjustable ring and a planetary base wheel, which is pivoted to a bottom of said substrate, said planetary base wheel allowing a minute wheel set to pass therethrough, said planetary base wheel having a bottom circumferentially pivotally mounted with a front hour wheel of said hour counter, and at least two engaging hooks being separate and individual, each of the at least two engaging hooks has a first end fixedly connected to a bottom of said substrate and a second end selectively engaging one of a plurality of ratchet holes that are arranged on the periphery of a top side of said time zone adjustable ring;

whereby stir said time zone adjustable ring with the hand to align a first landmark of a local time zone with a fixed point and then calibrate the time counting assembly in accordance with the local time, and then stir said time zone adjustable ring with the hand to align a second landmark of another locating time zone with said fixed point such that said inner gear ring moves said planetary idle gear set and said planetary base wheel to shift engagement of said engaging hooks in said ratchet holes, and said front hour wheel is rotated on said planetary base wheel with a planetary movement along said minute wheel set to cause rotation of a meshed hour wheel so as to turn a hour hand to the time in accordance with the time zone corresponding to said second landmark.

2. The time counting assembly with a display for world time zones according to claim 1, wherein said power source is disposed above said substrate and a circuit board providing a stepping motor with a rotor rotating with a constant speed and a power thereof being supplied by a battery;

said second counter provides a front second wheel meshing with said rotor and a second wheel respectively, said second wheel extending downward a second spindle to connect a second hand/disk on said faceplate;

said minute counter provides said front minute wheel meshing with said second wheel and a lower part thereof further meshing with a minute wheel set, said minute wheel set having a minute spindle extending from a bottom thereof over said faceplate and connecting with a minute hand; and said hour counter provides said front hour wheel to mesh with said minute wheel set and an hour wheel respectively, said hour wheel being passed through by a minute spindle, which extends over said faceplate to connect with an hour hand.

3. The time counting assembly with a display for world time zones according to claim 1, wherein said minute wheel set provides a minute wheel to movably fit with a minute wheel spindle, which is secured to said minute wheel with a retaining strip, said minute wheel spindle being disposed on the center of said substrate and passing through said planetary base wheel so as to mesh with said front hour wheel; and when calibrating the time, said minute wheel is driven by said front minute wheel to run idle.

4. The time counting assembly with a display for world time zones according to claim 1, wherein said ratchet holes are unidirectional, and the number of said ratchet holes is 24 corresponding to the 24 time zones.

5. The time counting assembly with a display for world time zones according to claim 1, further comprising a day-night display, said day-night display providing a day-night gear received in a hole on said faceplate and meshing with said hour wheel for rotation with said hour wheel, said day-night gear carrying a decoration mark as a day-night symbol to indicate the state of daytime/the state of nighttime.

6. The time counting assembly with a display for world time zones according to claim 1, wherein said planetary idle gear set provides a planetary idle gear pivotally disposed above said faceplate, and a planetary driven gear pivoted to said substrate.

7. The time counting assembly with a display for world time zones according to claim 6, wherein at least two pins and at least two pin holes are coupled between said planetary idle gear and said planetary driven gear to cause synchronous rotation between said planetary idle gear and said planetary driven gear.

8. The time counting assembly with a display for world time zones according to claim 1, further comprises a time calibration means, said time calibration means comprising a ratchet tooth stem meshing with a driven wheel that is pivoted to said substrate and meshes said minute wheel spindle, a time calibration knob for lifting and rotating said ratchet tooth stem, and spring mounted on said ratchet tooth stem and compressible by said ratchet tooth stem upon lifting of said ratchet tooth stem by said time calibration knob.

9. The time counting assembly with a display for world time zones according to claim 1, further comprising a cover fastened to a back side of said substrate, said cover having a stem hole and a battery hole for receiving a part of a time calibration means and a battery respectively.

10. The time counting assembly with a display for world time zones according to claim 1, wherein the time counting assembly is mounted in a casing, said casing having a landmark ring at a front side thereof, said landmark ring carrying thereon typical city names corresponding to the 24 time zones, said landmark ring having a plurality of connecting portions to connect said time zone adjustable ring, a lens on a front side of said landmark ring, a back cover on a back side of said casing, said landmark ring moving said time zone adjustable ring and said hour counter for viewing the time in another one of the 24 time zones when rotated.

* * * * *